US005910386A

United States Patent [19]

Yoshinaga et al.

[11] Patent Number: 5,910,386

[45] Date of Patent: Jun. 8, 1999

[54] ELECTROPHOTOGRAPHIC PHOTOSENSITIVE MEMBER, AND ELECTROPHOTOGRAPHIC APPARATUS AND PROCESS CARTRIDGE EMPLOYING THE SAME

[75] Inventors: Kazuo Yoshinaga, Kawasaki; Shunichiro Nishida, Yokohama; Masataka Kawahara; Keiko Hiraoka, both of Shizuoka-ken; Nobuo Kushibiki, Fujisawa; Hideki Kobayashi, Ichihara; Kikuko Takeuchi, Odawara; Toru Masatomi, Ichihara, all of Japan

[73] Assignee: Canon Kabushiki Kaisha, Tokyo, Japan

[21] Appl. No.: 08/890,649

[22] Filed: Jul. 9, 1997

[30] Foreign Application Priority Data

Jul. 9, 1996 [JP] Japan ..... 8-179001

[51] Int. Cl.[6] ..... G03G 5/14

[52] U.S. Cl. ..... 430/66; 430/67

[58] Field of Search ..... 430/66, 67, 129; 399/159

[56] References Cited

U.S. PATENT DOCUMENTS

| | | | |
|---|---|---|---|
| 3,994,702 | 11/1976 | Clark | 428/288 |
| 4,027,073 | 5/1977 | Clark | 428/412 |
| 4,923,775 | 5/1990 | Schank | 430/59 |

FOREIGN PATENT DOCUMENTS

| | | |
|---|---|---|
| 57-30843 | 2/1982 | Japan . |
| 61-132954 | 6/1986 | Japan . |
| 4-324454 | 11/1992 | Japan . |

*Primary Examiner*—John Goodrow
*Attorney, Agent, or Firm*—Fitzpatrick, Cella, Harper & Scinto

[57] ABSTRACT

An electrophotographic photosensitive member is disclosed which has a photosensitive layer and a protection layer. The protection layer contains a particulate colloidal silica and a siloxane resin to have a contact angle of water of not less than 90°. The photosensitive member has a lowered surface energy and excellent mechanical and electrical durability.

9 Claims, 4 Drawing Sheets

ELECTROPHOTOGRAPHIC PHOTOSENSITIVE MEMBER, AND ELECTROPHOTOGRAPHIC APPARATUS AND PROCESS CARTRIDGE EMPLOYING THE SAME

BACKGROUND OF THE INVENTION

1. Field of the Invention

The present invention relates to an electrophotographic photosensitive member widely used for copying machines, printers, engraving systems, and the like apparatuses. The present invention relates also to an electrophotographic apparatus and a process cartridge employing the above electrophotographic photosensitive member.

2. Related Background Art

Conventionally, an electrophotographic photosensitive member directly undergoes electric or mechanical action in the processes of electric charging such as corona charging and roller charging, image development, image transfer, cleaning, and so forth, and is required to have durability against the above action.

Specifically, the electrophotographic photosensitive member should be resistant to abrasion and scratching by friction on the surface, and to electrical deterioration. In particular, in a charging system like a roller charging system utilizing electric discharge, the photosensitive member should be durable against high energy arc discharge.

Further, there are some problems of the toner attaching to the surface of the photosensitive member caused by the repeated development with the toner and the repeated cleaning of the photosensitive member. To cope with the problems, the surface of the photosensitive member is required to have improved cleanability.

To satisfy the above requirements for the photosensitive member surface, a surface protection layer mainly composed of a resin is provided. For example, Japanese Patent Application Laid-Open No. 57-30843 discloses a protection layer in which a particulate metal oxide is added as electroconductive particles to control the resistance.

Besides the protection layer itself, incorporation of an additive into the charge-transporting layer is studied to improve the properties of the photosensitive member surface. For example, the following silicone resins having a low surface energy are reported as the additive:

silicone oil (Japanese Patent Application Laid-Open No. 61-132954), polydimethylsiloxane, powdery silicone resin (Japanese Patent Application Laid-Open No. 4-324454), crosslinked silicone resin, poly(carbonate-silicone) block copolymer, silicone-modified polyurethane, and silicone-modified polyester.

The typical polymer of a low surface energy includes fluoropolymers. The fluoropolymers below are useful as the additive for the photosensitive layer:

powdery polytetrafluoroethylene, and powdery fluorocarbons.

However, a surface protection layer containing a metal oxide or the like, which has a higher hardness, tends to have a higher surface energy to result in lower cleanability and other shortcomings. A silicone type resin, which is advantageous as the additive in lowering the surface energy, is less compatible with other polymers, and as a result, when the silicone resin is incorporated into the photosensitive member, such resin tends to agglomerate to cause light scattering, or tends to bleed out and deposit to the surface to render unstable the properties of the photosensitive member, disadvantageously. A fluoropolymer typified by polytetrafluoroethylene (PTFE) has a low surface energy, but is insoluble in solvents and less dispersible, producing a less smooth surface of the photosensitive member. Further, the fluoropolymer has a low refractive index, causing generally light scattering and deterioration of the latent image thereby.

High polymers like polycarbonate, polyacrylate esters, polyesters, and polytetrafluoroethylene are generally less resistant to arc discharge, and readily deteriorate by fission of the polymer main chain by electric discharge.

SUMMARY OF THE INVENTION

An object of the present invention is to provide an electrophotographic photosensitive member which has low surface energy and excellent mechanical and electrical durability, and produces image of high resolution without light scattering and surface-bleeding.

Another object of the present invention is to provide an electrophotographic apparatus and a process cartridge employing the electrophotographic photosensitive member.

The present invention provides an electrophotographic photosensitive member comprising a photosensitive layer and a protection layer formed on a support, the protection layer containing particulate colloidal silica and a siloxane resin to have a contact angle of water of not less than 90°.

In another aspect, the invention provides an electrophotographic apparatus comprising the electrophotographic photosensitive member mentioned above, a charging means for charging the electrophotographic photosensitive member, an image exposure means for exposing the charged electrophotographic photosensitive member to image light to form an electrostatic latent image thereon, and a development means for developing the formed electrostatic latent image with a toner on the electrophotographic photosensitive member.

In a further aspect, the invention provides a process cartridge comprising the electrophotographic photosensitive member mentioned above, and at least one of a charging means, a development means, and a cleaning means, combined together into one unit.

DESCRIPTION OF THE PREFERRED EMBODIMENTS

Figure 1:
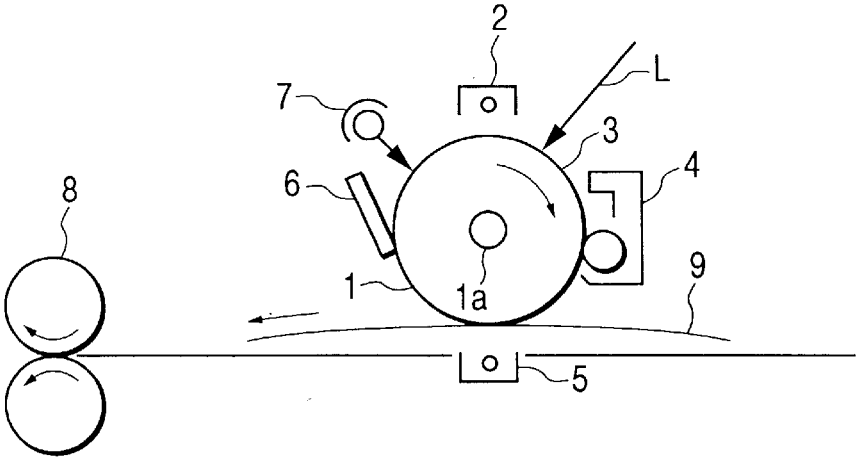
FIG. 1 is a schematic front view of an example of the electrophotographic apparatus of the present invention.

The electrophotographic photosensitive member of the present invention has a photosensitive layer and a protection layer formed in this order on a support. The protection layer contains a particulate colloidal silica and a siloxane resin to have a contact angle of water of not less than 90°.

The protection layer of the present invention comprises a hydrolysis condensate of a multi-functional organosilicon compound having in the molecule an OH group or a hydrolyzable group such as an OR' group. This protection layer is formed by applying a protection layer composition containing the colloidal silica and an organosilicon compound having a hydrolyzable group, and drying and curing it. In the present invention, the "particulate colloidal silica" means particles contained in the colloidal silica.

Preferred organosilicon compound having a hydrolyzable group includes trifunctional ones represented by the formula $R—Si(OR')_3$, wherein R is an alkyl group of 1–3 carbons, a vinyl group, a fluorine-containing organic group, a γ-glycidoxypropyl group, or a γ-methacryloxypropyl group; and R' is a hydrogen atom, or an alkyl group of 1–3 carbons. In particular, for the composition for forming a protection layer, the organosilicon compound having a hydrolyzable group is preferably a mixture of a first organosilicon compound having an alkyl group as the group R and a second organosilicon compound having a fluorine-containing organic group as the group R. The fluorine-containing organic group is preferably $C_nF_{2n+1}C_2H_4$— where n is an integer of preferably from 4 to 18, more preferably from 4 to 8.

The solvent for dispersion of the protection layer forming composition includes a mixed solvent of a lower aliphatic alcohol such as methanol, ethanol, isopropanol, t-butanol, or n-butanol, and water. A water-soluble solvent such as glycol and acetone may be further added to the above solvent.

The solid content of the protection layer forming composition is preferably in the range of from 1% to 50% by weight. The composition of the solid content of higher than 50% by weight tends to deteriorate to become poor in film-forming property owing to gelation or other phenomenon, whereas the composition of the solid content of less than 1% by weight tends to be poor in the strength of the protection layer. The ratio of the particulate colloidal silica in the solid components is in the range of from 10% to 70% by weight. At the ratio of higher than 70% by weight, the coating film tends to be brittle and is liable to crack, whereas at the ratio of lower than 10% by weight, the surface protection layer tends to have insufficient hardness.

The particles of the colloidal silica have an average particle diameter ranging preferably from 5 to 150 nm, more preferably from 10 to 30 nm in view of the dispersion stability and optical properties.

The colloidal silica for the protection layer composition includes commercially available water-dispersions, exemplified by Ludox (trade name, produced by E.I. duPont de Nemours & Co.), and Nalcoag (trade name, produced by Nalco Chemical Co.). The colloidal silica preferably contains an alkali metal such as Na at a content of not more than 2% by weight in terms of the alkali metal oxide.

The composition for the protection layer of the electrophotographic photosensitive member is preferably adjusted to be in an acidic state of pH 3.0 to 6.0 by addition of an inorganic or organic acid. A weak acid is preferred since a strong acid can affect adversely the stability and other properties of the composition. More preferably the pH is adjusted to be in the range from 4.0 to 5.5 by addition of a weak acid.

The composition for the protection layer of the electrophotographic photosensitive member is applied onto the photosensitive layer of the photosensitive member by a known coating method such as immersion coating and spray coating, and then dried and heat-cured to develop the hardness, strength, low surface energy, and resistance to discharge. The heat curing proceeds more completely at a higher temperature. The curing temperature is selected not to cause adverse effect to the properties of the electrophotographic photosensitive member, preferably in the range of from 80 to 180° C., more preferably from 100 to 150° C.

The curing proceeds more completely in a longer time, and the curing time is selected not to cause adverse effect to the properties of the electrophotographic photosensitive member at the curing temperature. The curing time is usually in the range of from 10 minutes to 12 hours.

The protection layer obtained after drying followed by the heat-curing contains particulate colloidal silica and a siloxane resin represented by the formula of $RSiO_{3/2}$. This $RSiO_{3/2}$ is produced by the hydrolysis condensation of $R—Si(OR')_3$.

The protection layer of the present invention can achieve a low surface energy, preferably giving a water contact angle of not smaller than 90°. In particular, satisfactory results are obtained with the siloxane resin having a fluorine-containing organic group as the group R. The protection layer having a water contact angle of less than 90° tends to cause problems that electrification products, a toner, scum of paper, and the like are attached to the surface of the photosensitive member during the repeated use in the electrophotographic process and that the latent image deteriorates (image smearing) due to the insufficient cleaning and the lowered surface resistance. The water contact angle is more preferably 95° or more. On the contrary, an excessively large water contact angle causes insufficient adhesion of the protection layer to the photosensitive layer. Therefore, the water contact angle is preferably not larger than 140°.

The protection layer of the present invention has a high surface hardness in addition to the aforementioned low surface energy. Generally, lowering the surface energy results in reduced surface hardness. However, in the present invention, the low surface energy and the high surface hardness can be achieved simultaneously owing to the siloxane resin bonding to the surface of the colloidal particles in the protection layer.

The protection layer has preferably a hardness of not lower than the pencil hardness of 5H when the layer is formed on a glass plate. The protection layer having the hardness of lower than 5H is liable to be scratched or scraped by the toner or a powder of the paper used in the electrophotography process. Since the hardness of higher than 9H is outside the measurement range of the pencil hardness test, the surface hardness of the protection layer may be measured by the universal hardness (Hu, unit: $N/mm^2$) by a nanoindentation method. The universal hardness of the protection layer of the present invention is preferably in the range of from 350 to 2000 $N/mm^2$. The universal hardness is generally correlated with the pencil hardness. The pencil hardness of 5H or higher corresponds to the universal hardness of 350 $N/mm^2$ or higher. The protection layer having the universal hardness of higher than 2000 $N/mm^2$ tends to be cracked by impact or other mechanical shock owing to a large difference in hardness between the protection layer and the photosensitive layer.

The surface hardness of the protection layer can be controlled to be at a desired level by selecting the particle diameter of the particulate colloidal silica and the degree of hydrolysis condensation.

In the present invention, the universal hardness was measured by means of Fischerscope H100V (manufactured by Helmut Fischer GMBH & Co.). The protection layer sample was formed in a thickness ranging from 4 to 5 μm on a glass plate. The indentation depth of the indenter was 1 μm.

The colloidal silica is used in various application fields as shown in U.S. Pat. No. 3,944,702, and U.S. Pat. No. 4,027,073. In the present invention, the colloidal silica is used for achieving a lower surface energy and a higher surface hardness of the protection layer of the electrophotographic photosensitive member.

The thickness of the protection layer is preferably in the range of from 0.1 to 4 μm. The protection layer with a thickness of less than 0.1 μm is not sufficient in the surface hardness and strength, and is liable to be less durable, whereas the protection layer with a thickness of more than 4 μm tends to lower the contrast potential of the latent image in the development. The thickness is more preferably in the range of from 0.2 to 3 μm.

The volume resistivity of the protection layer is preferably in the range of from $1\times10^{9}$ to $1\times10^{15}$ Ωcm. The protection layer of lower than $1\times10^{9}$ Ωcm causes diffusion of the electric charge of the formed latent image to result in deterioration of the latent image, whereas the one of higher than $1\times10^{15}$ Ωcm tends to retard the movement of electric charges in the electrophotographic photosensitive member in the process from the light exposure to the development to lower the sensitivity apparently and to raise the residual potential.

The hydrolyzable groups like the silanol groups remaining in the protection layer, which will raise the residual potential, should desirably be decreased to the minimum. The content of the hydrolyzable groups in the protection layer is preferably lower than 0.1% by weight, more preferably lower than 0.01% by weight, in terms of SiOH.

The protection layer is formed on the photosensitive layer by application of a protection layer forming composition by the immersion coating, blade coating, roll coating, or a like coating method. The solvent for the protection layer forming composition is preferably the one which does not corrode the photosensitive layer. However, even a solvent corrosive to the photosensitive layer can be applied by the spray coating with less adverse effect.

The support for the electrophotographic photosensitive member may be constituted of a material which is electroconductive by itself such as aluminum, aluminum alloys, copper, zinc, stainless steel, chromium, titanium, nickel, magnesium, indium, gold, platinum, silver, and iron; a dielectric material such as a plastic material having a vapor-deposited electroconductive coating layer of aluminum, indium oxide, tin oxide, or gold; or a plastic or paper sheet having electroconductive fine particles dispersed therein. The electroconductive support should be uniform in electroconductivity and have a smooth surface. The surface roughness of the support is preferably not more than 1.0 μm since the surface roughness affects greatly the uniformity of the subbing layer, the charge-generating layer, and the charge-transporting layer formed thereon.

In particular, an electroconductive layer can readily be formed by applying onto a support a dispersion of electroconductive fine particles in a binder. The support having such an electroconductive layer has a uniform surface, and is useful. The electroconductive fine particles have a primary particle diameter of not more than 100 nm, preferably not more than 50 nm. The material for the electroconductive fine particles includes electroconductive zinc oxide, electroconductive titanium oxide, Al, Au, Cu, Ag, Co, Ni, Fe, carbon black, ITO, tin oxide, indium oxide, and indium. The fine particles may be insulating particles coated with an electroconductive material shown above. The electroconductive fine particulate material is used in such an amount that the volume resistivity of the electroconductive layer is made sufficiently low, preferably the resistivity being not higher than $1\times10^{10}$ Ωcm, more preferably not higher than $1\times10^{8}$ Ωcm.

Between the electroconductive support and the photosensitive layer, a subbing layer may be provided which has an injection inhibiting function and an adhesive function. The material for forming the subbing layer includes casein, polyvinyl alcohol, nitrocellulose, ethylene-acrylic acid copolymers, polyvinylbutyral, phenol resins, polyamides, polyurethane resins, and gelatin. The thickness of the subbing layer ranges preferably from 0.1 to 10 μm, more preferably from 0.3 to 3 μm.

The photosensitive layer may be of a single layer structure, or may be a laminate of a charge-generating layer and a charge-transporting layer formed in this order, or a charge-transporting layer and a charge-generating layer formed in this order on a support.

The photosensitive layer of a single layer structure can be formed by mixing a charge-generating material, a charge-transporting material and a binder resin in a solvent, and forming the mixture into a film by a usual coating method.

In formation of the photosensitive layer constituted of a charge-generating layer and a charge-transporting layer, the charge-generating layer is formed by mixing at least a charge-generating material and a binder resin in a solvent, and applying the mixture by a conventional coating method to form a film; and the charge-transporting layer is formed by mixing at least a charge-transporting material and a binder resin in a solvent, and applying the mixture by a conventional coating method to form a film.

The charge-generating material includes selenium-tellurium, pyrylium dyes, thiopyrylium dyes, phthalocyanine pigments, anthanthorone pigments, dibenzopyrenequinone pigments, pyranthrone pigments, trisazo pigments, disazo pigments, azo pigments, indigo pigments, quinacridone pigments, cyanine pigments, and the like.

The charge-transporting material is classified into two groups: electron-transporting compounds and positive hole-transporting compounds. The electron-transporting compounds include electron-accepting compounds such as 2,4,7-trinitrofluorenone, 2,4,5,7-tetranitrofluorenone, chloranil, tetracyanoquinodimethane, and alkyl-substituted diphenoquinones, and polymerizates of the electron-accepting compound. The positive hole-transporting compounds include polynuclear aromatic compounds such as pyrene, and anthracene; heterocyclic compounds such as carbazole, indole, oxazole, thiazole, oxathiazole, pyrazole, pyrazoline, thiadiazole, and triazole; hydrazones such as p-diethylaminobenzaldehyde-N,N-diphenylhydrazone, and N,N-diphenylhydrazino-3-methylidene-9-ethylcarbazole; styryl compounds such as α-phenyl-4'-N,N-diphenylaminostilbene, and 5-(4-(di-p-tolylamino) benzylidene)-5H-dibenzo(a,d)cycloheptene; benzidine compounds; triarylamines; and polymers having the radicals of the above compound in the main chain or the side chain (e.g., poly-N-vinylcarbazole, polyvinylanthracene, etc.).

The binder resin for the respective layers includes polymers and copolymers of vinyl compounds such as styrene, vinyl acetate, vinyl chloride, acrylate esters, methacrylate esters, vinylidene fluoride, and trifluoroethylene; polyvinyl alcohol, polyvinylacetals, polycarbonates, polyesters, polysulfones, polyphenylene oxides, polyurethane resins, cellulose resins, phenol resins, melamine resins, organosilicone resins, and epoxy resins.

In the photosensitive layer of a single layer structure, the charge-generating material is contained in a content ranging preferably from 3% to 30% by weight based on the solid matter of the photosensitive layer, and the charge-transporting material is contained in a content ranging preferably from 20% to 70% by weight based on the solid matter of the photosensitive layer.

In the photosensitive layer constituted of two layers of a charge-generating layer and a charge-transporting layer, the charge-generating material is contained in the charge-generating layer in a content ranging preferably from 20% to 80%, more preferably from 30% to 70%, by weight based on the solid matter of the charge-generating layer, and the charge-transporting material is contained in the charge-transporting layer in a content ranging preferably from 20 to 70% by weight based on the solid matter of the charge-transporting layer.

The photosensitive layer of a single layer structure has a thickness ranging preferably from 3 to 40 $\mu$m. The photosensitive layer of a laminated structure has a charge-generating layer of a thickness ranging preferably from 0.05 to 1.0 $\mu$m, more preferably from 0.1 to 0.5 $\mu$m, and a charge-transporting layer of a thickness ranging preferably from 1 to 30 $\mu$m, more preferably from 3 to 20 $\mu$m.

An electrophotographic apparatus is described which employs an electrophotographic photosensitive member of the present invention.

In FIG. 1, a drum-shaped photosensitive member 1 of the present invention is driven to rotate in the direction shown by an arrow mark around an axis 1*a* at a prescribed peripheral speed. During the rotation, the regions of the peripheral surface successively pass through the processes below. A region of the photosensitive member 1 is electrically charged uniformly at a prescribed positive or negative potential at the peripheral surface by a charging means 2. Then the charged region is subjected to light image exposure L (slit exposure or laser beam scanning light exposure) at a light exposure zone 3 by a light image exposure means not shown in the drawing to successively form a latent image corresponding to the projected light image on the peripheral face of the photosensitive member with the rotation. The formed latent image is developed with a toner by a development means 4. The developed toner image is successively transferred by a corona transfer means 5 onto the face of a recording medium 9 fed synchronously with the rotation of the photosensitive member 1 between the photosensitive member 1 and the transfer means 5 by a paper-sheet feeder not shown in the drawing. The recording medium 9 having received the transferred image is separated from the surface of the photosensitive member, and is introduced to an image-fixing means 8 to have the image fixed. Then the recording medium is delivered as a copy out of the apparatus. The surface of the region of the photosensitive member 1 after the image transfer is cleaned by a cleaning means 6 to remove any residual toner, and is subjected to the charge eliminating treatment by a pre-exposure means 7 for subsequent image formation. A corona charging apparatus is widely used as the charging means 2 for uniform charging of the photosensitive member 1.

Figure 2:
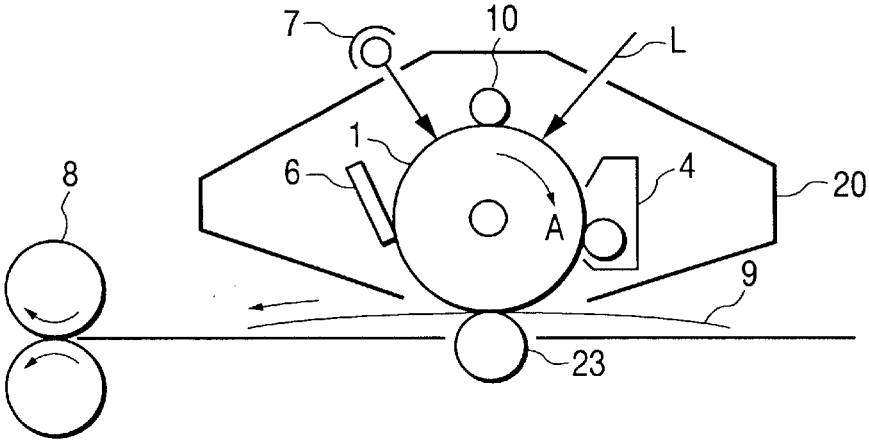
FIG. 2 is a schematic front view of another example of the electrophotographic apparatus of the present invention.
Figure 3:
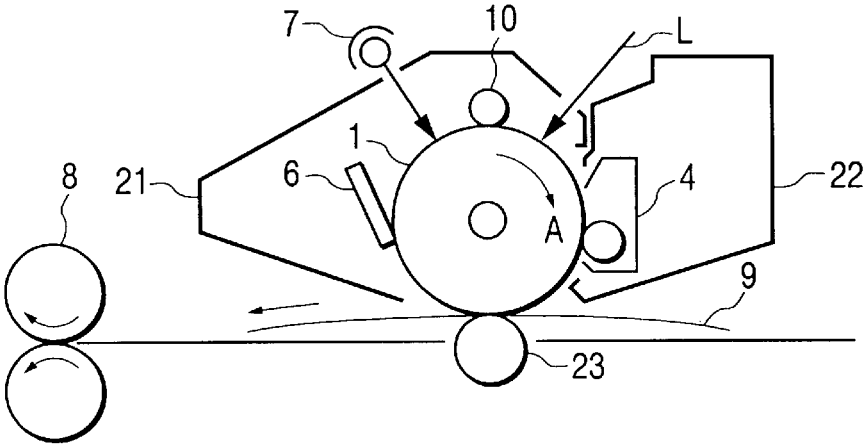
FIG. 3 is a schematic front view of still another example of the electrophotographic apparatus of the present invention.

As shown in FIG. 2 and FIG. 3, the photosensitive member 1 may be electrically charged by a voltage-applied direct charging member 10 brought into contact with it. This charging method is hereinafter referred to as "direct charging".

In the apparatus shown in FIG. 2 and FIG. 3, the toner image on the photosensitive member 1 is transferred onto a recording medium 9 by a direct charging means 23. More specifically, a potential is applied to the direct charging member 23, and the toner image on the photosensitive member 1 is transferred onto the recording medium 9 by contact with the direct charging member 23.

The apparatus shown in FIG. 2 is an electrophotographic apparatus unit which comprises at least a photosensitive member 1, a direct charging member 10, and a development means 4 placed in a vessel 20 and combined together into one electrophotographic apparatus unit, and this apparatus unit is constituted so as to be detachable from the main apparatus by use of a guiding means such as a rail in the main apparatus. The cleaning means 6 may be placed, or not placed in the vessel 20.

The apparatus shown in FIG. 3 comprises a first electrophotographic apparatus unit comprising at least a photosensitive member 1, an a direct charging member 10 placed in a first vessel 21, and a second electrophotographic apparatus unit comprising at least a development means 4 placed in a second vessel, the first apparatus unit and the second apparatus unit being detachable from the main body of the electrophotographic apparatus. The cleaning means 6 may be placed or not placed in the vessel 21.

In recent years, the demand for resolution and gradation of the image is becoming severer for the electrophotographic image forming apparatus. Investigations have been made to meet the above demand. As the results, the inventors of the present invention have found that in an electrophotographic image forming apparatus in which a beam of light is projected to form a latent image, there is a certain relation between the gradation reproducibility and the product of the thickness of the photosensitive layer of the photosensitive member and the projected light spot area. Specifically, 400 dpi and 256 gradation can be realized by controlling the product of the spot area and photosensitive layer thickness of the photosensitive member to be not more than 20000 $\mu m^3$. This means that in general, the photosensitive layer thickness, chiefly the charge-transporting layer, of the photosensitive member using the realizable finest light spot is suitably not more than 12 $\mu$m. Thus, a smaller thickness of the photosensitive layer is desired. On the other hand, the photosensitive layer thickness of 1 $\mu$m or more, preferably 3 $\mu$m or more, is desired for prevention of pinhole formation and sensitivity drop at the same charging potential.

Figure 4:
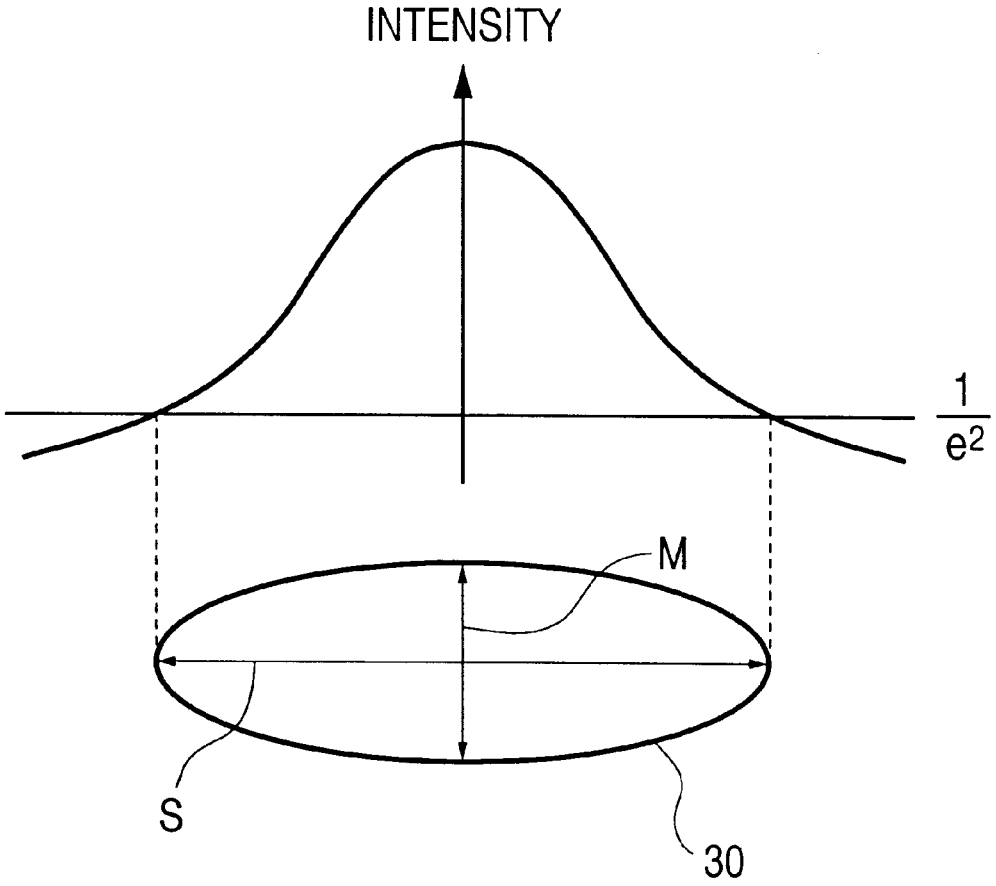
FIG. 4 shows a relation between the light intensity distribution in an irradiation light beam and a spot area.

As shown in FIG. 4, the spot area of the light beam 30 is the area of the region in which the intensity of the light is not lower than $1/e^2$ times the peak intensity. The useful light beam includes light of semiconductor laser scanning, and light of a solid scanner such as LED, and liquid crystal shutter. The light intensity distributes according to Gauss distribution, Lorentz distribution, or other types of distribution. Regardless of the light intensity distribution, the spot area is the area of the region in which the intensity of the light is not lower than $1/e^2$ times the peak intensity. The light spot is generally in an ellipsoidal shape as shown in FIG. 4, where M represents the spot diameter in the main scanning direction, and S represents the spot diameter of the auxiliary scanning direction.

Other examples of the electrophotographic apparatus of the present invention are described by reference to FIG. 5 and FIG. 6.

Figure 5:
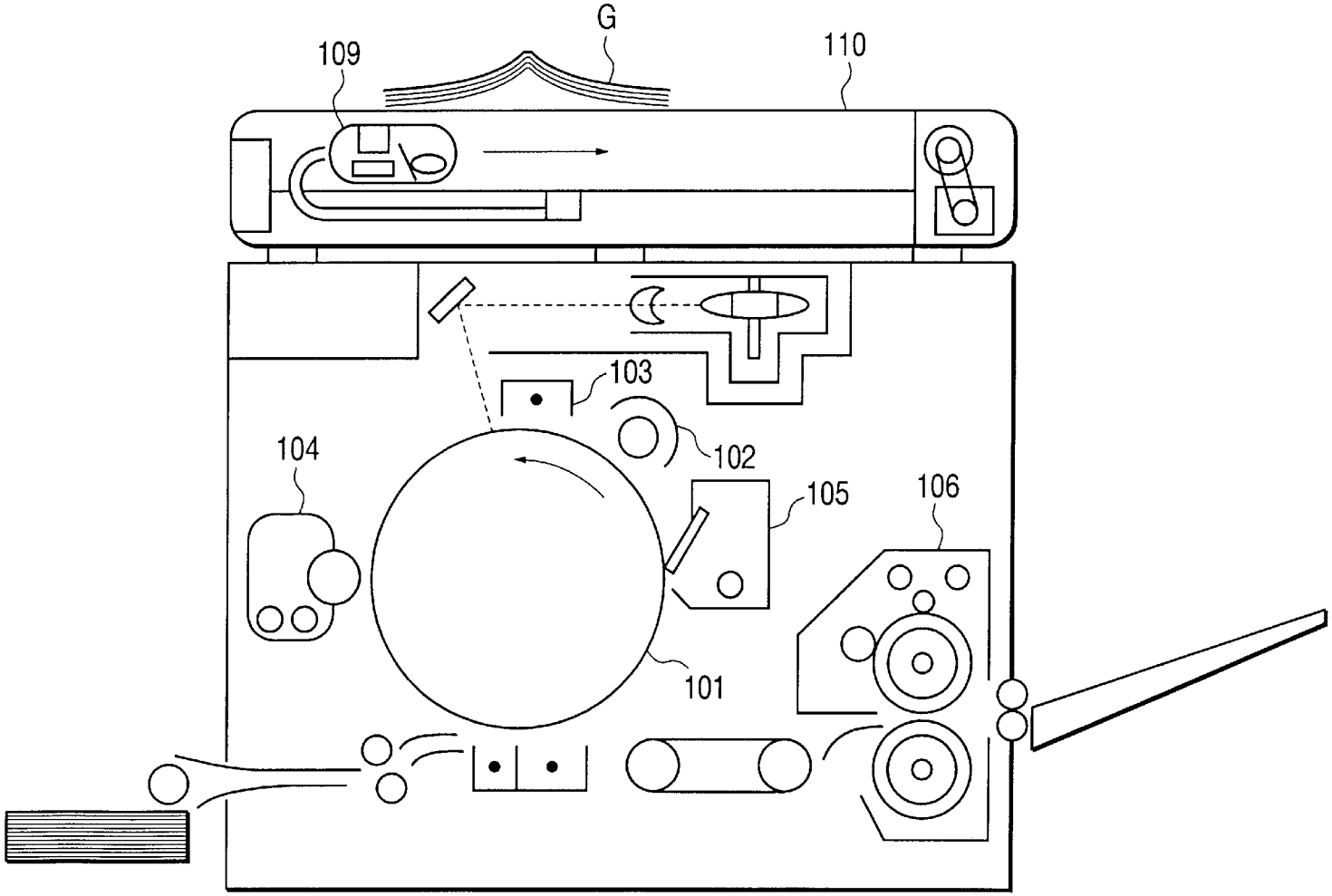
FIG. 5 is a schematic front view of a further example of the electrophotographic apparatus of the present invention.

In FIG. 5, an original copy G is placed on an original copy holder 110 with the face to be copied being directed downward. Copying operation is started by pressing a start button. A unit 109 comprising an original-irradiating lamp, a short focus lens array, and a CCD sensor which are combined together, scans the original copy with the irradiation light beam. The projected scanning light is formed into an image, and the image light is introduced to the CCD sensor. The CCD sensor is constituted of a light-receiving portion, a transmission portion, and an output portion. In the CCD light-receiving portion, the optical signals are converted to electric signals. The converted signals are synchronized with a clock pulse and are transmitted successively to the output portion. In the output portion, the charge signals are converted to voltage signals, amplified, reduced in impedance, and output. The obtained analog signals are converted to digital signals, and are further treated for image formation to optimize the resolution and gradation for the desired image characteristics. The treated digital signals are transmitted to a printer portion. In the printer portion, a latent image is formed in accordance with the image signals as follows. The photosensitive drum 101 rotates around a center supporting axis at a prescribed peripheral speed. In the process of rotation, the drum is positively or negatively charged uniformly at a prescribed voltage by a charging means 103. The uniformly charged surface is scanned with a light beam of a solid laser element turned on and off in corresponding with the image signal by means of a polygon mirror rotating at a high speed to form a latent image successively on the face of the photosensitive drum 101 corresponding to the original copy. The apparatus is provided with a pre-exposure means 102, a charging means 103, a development means 104, a cleaning means 105, and a fixing means 106.

Figure 6:
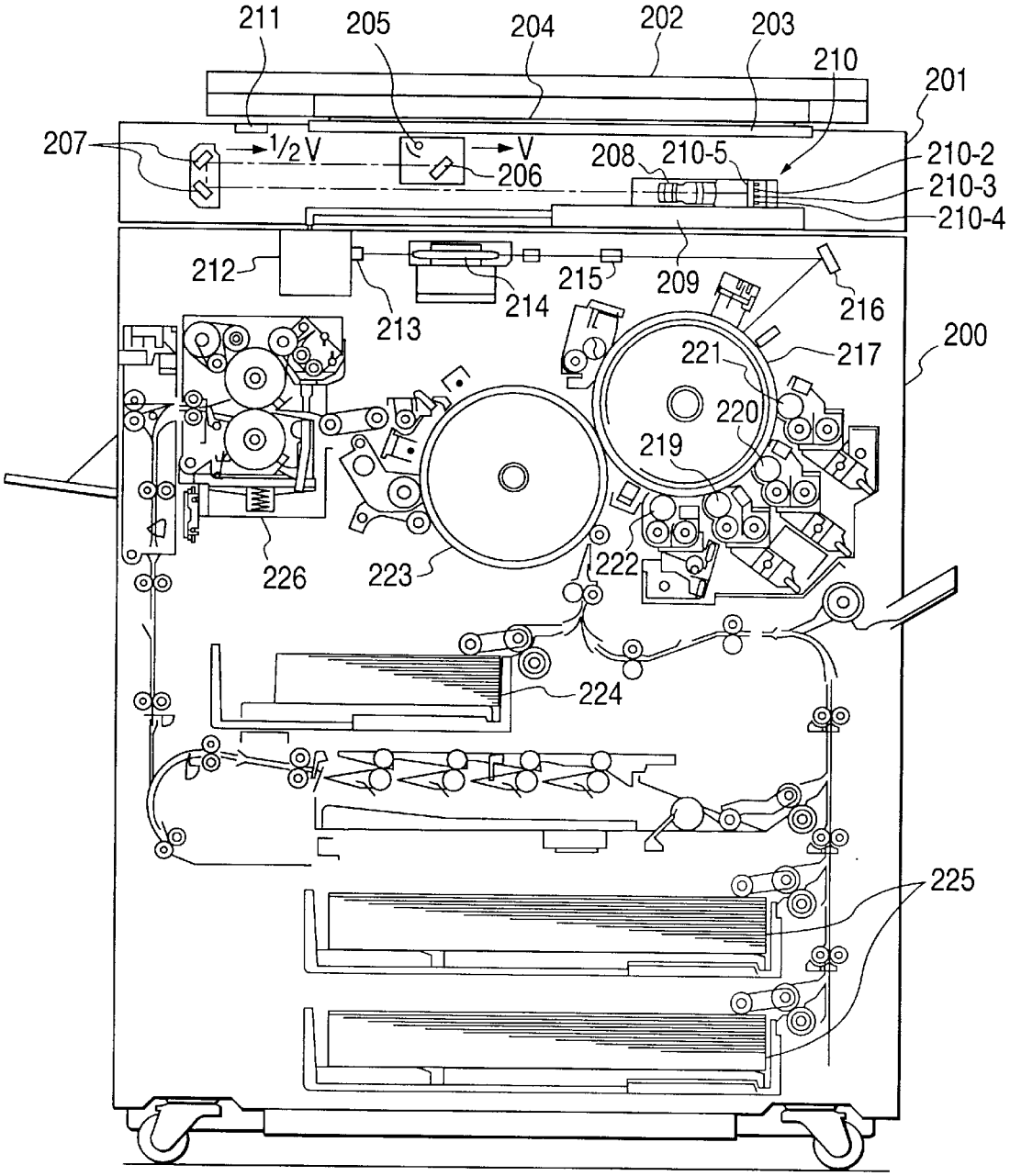
FIG. 6 is a schematic front view of a still further example of the electrophotographic apparatus of the present invention.

FIG. 6 illustrates a color copying machine of the present invention.

In FIG. 6, an image scanner potion 201 reads the original copy and converts the information into digital signals. A printer portion 200 outputs the image having been read by an image scanner 201 in full color onto a paper sheet.

In the image scanner portion 201, an original copy-pressing plate 202 serves to fix an original copy 204 on an original copy holding glass plate 203 (hereinafter referred to as a platen). The original copy 204 is irradiated with light from an halogen lamp 205. The light reflected by the original copy 204 is introduced to mirrors 206, 207, and forms an image through a lens 208 on a three-line sensor 210 (hereinafter referred to as a CCD) constituted of three CCD line sensors. The CCD 210 separates the full-color optical information from the original copy into color components of red (R), green (G), and blue (B), and transmits the color components to a signal treating portion 209. The halogen lamp 205 and the mirror 206 move at a speed of v, and the mirror 207 moves at a speed of (½)v mechanically in a direction (hereinafter "auxiliary scanning direction") perpendicular to the electrical scanning direction (hereinafter "main scanning direction") to scan the entire face of the original copy.

A standard white board 211 is employed for generation of data for shading correction to correct the read-out data of the line sensors 210-2, 210-3, and 210-4 corresponding respectively to the components of R, G, and B. This standard white board has uniform spectral reflection characteristics to visible light. The output data of the R, G, and B visible sensors 210-2, 210-3, and 210-4 are corrected by use of the standard white board.

The signal treating portion 209 treats electrically the read signals to separate the signals into components of magenta (M), cyan (C), yellow (Y), and black (Bk), and transmits them to a printer portion 200. For one scanning of the original copy in the image scanning portion, respective color components of M, C, Y, and Bk are transmitted successively to the printer 200 for one color-picture image formation by four separate color scanning steps.

The image signals of M, C, Y, and Bk from the image scanning portion 201 are transmitted to a laser driver 212. The laser driver 212 modulates and drives a semiconductor laser 213 in accordance with the image signal. The laser light is allowed to scan a photosensitive drum 217 through a polygon mirror 214, an f-θ lens 215, and a mirror 216.

Development devices 219–222 are constituted of a magenta development device 219, a cyan development device 220, a yellow development device 221, and a black development device 222. The four development devices are successively brought into contact with the photosensitive drum to develop the latent images of M, C, Y and Bk formed on the photosensitive drum 217 with the corresponding toner. Onto a transfer drum 223, a paper sheet is delivered from a paper sheet cassette 224, or 225. The toner image developed on the photosensitive drum 217 is transferred onto the paper sheet. After successive transfer of the four color images of M, C, Y, and Bk, the paper sheet is passed through a fixation unit 226 to have the image fixed, and is driven out of the apparatus.

The present invention is described below in more detail by reference to Examples. In the description below, the unit "part" is based on weight unless otherwise mentioned.

EXAMPLE 1

In a flask, was placed 8.7 g of an aqueous dispersion of colloidal silica (solid content: 40% by weight). To the aqueous dispersion were added 20.5 g of a dispersion of colloidal silica in isopropyl alcohol (solid content: 30% by weight), 25.6 g of methyltriethoxysilane, 5.9 g of 3,3,4,4,5,5,6,6,6-nonafluorohexyltrimethoxysilane, and 3.2 g of acetic acid with stirring. After completion of the addition, the mixture solution was heated to 65 to 70° C. to allow the reaction to proceed for 2 hours. Then the reaction mixture was diluted with 21.7 g of isopropyl alcohol, and further, 2.4 g of benzyltrimethylammonium acetate as a curing catalyst, and 0.16 g of a solution of 10% by weight of polyether-modified dimethylsilicone in ethanol were added to obtain a protection layer forming composition (which is called composition I).

This protection layer forming composition I was applied onto a glass plate by the bar coating, dried and heat-treated at 110° C. for 4 hours. After the drying, a sample having a uniform transparent film of 1 μm thick thus formed was obtained. This is called sample I.

The sample I was measured as to the absorption at a wavelength of 600 nm by use of a spectro-photometer. As a result, the film of the sample had an absorbance of 0.001 per μm film thickness and was transparent.

The water contact angle was measured and found to be 99°, showing sufficiently lowered surface energy of the film. The pencil hardness was as high as 9H. The volume resistivity was $1\times10^{14}$ Ωcm as measured by use of a comb type electrode. The universal hardness Hu was 652 $N/mm^2$.

Separately, 4-[2-(triethoxysilyl)ethyl]triphenylamine, and a polycarbonate resin (trade name: Z-200, produced by Mitsubishi Gas Chemical Co., Inc.) were dissolved in tetrahydrofuran in the solid contents of 50% and 50% by weight, respectively. This solution was applied on an aluminum plate of 50 μm thick by the bar coating and dried at 120° C. for one hour to form a transparent uniform film of 20 μm thick.

Onto this film, the previously prepared protection layer forming composition I was applied by bar coating, and was dried and heat-treated at 110° C. for 4 hours to obtain a sample having a surface protection layer of 1 μm thick formed thereon. This is called sample II. The sample II was examined with a microscope and found to have a uniform protection layer formed thereon.

An electroconductive rubber roller was brought into contact with the protection layer of the sample II, and the aluminum plate thereof was grounded. An AC voltage of a peak-to-peak voltage of 1,500 V and a frequency of 1,500 Hz superposed on a DC voltage of −600 V was applied to the electroconductive rubber roller for one hour to test the deterioration caused by electric discharging. In the deterioration test, the resistance to discharge was evaluated by the depth of a hollow or recess which was formed by the electric discharge in the vicinity of the portion of the sample II with which the roller was brought into contact. In this Example, the depth of the hollow was measured and found to be as small as less than 0.1 μm.

The water contact angle at the electric discharge portion was 95° after the deterioration test, which was satisfactory in comparison with the value of 99° before the deterioration test.

EXAMPLE 2

A liquid dispersion for forming an electroconductive layer was prepared by dispersing 200 parts of ultrafine particulate electroconductive barium sulfate (primary particle diameter: 50 nm) and 3 parts of particulate silicone resin (average particle diameter: 2 μm) in a solution of 167 parts of a phenol resin (trade name: Priophen, Dainippon Ink and Chemicals, Inc.) in 100 parts of methylcellosolve. This dispersion was applied on an aluminum cylinder of 30 mm in the outside diameter which was obtained by the drawing. The immersion coating was used to form an electroconductive layer in a film thickness of 15 μm after drying.

Thereon, a subbing layer was formed in a dry thickness of 1 μm in such a manner that by a solution of 5 parts of alcohol-soluble copolymeric nylon (trade name: Amylan CM-8000, Toray Industries, Inc.) in 95 parts of methanol was applied by the immersion coating and dried at 80° C. for 10 minutes.

A dispersion for forming a charge-generating layer was prepared by dispersing 5 parts of I-type titanyloxy phthalocyanine pigment in a solution of 2 parts of polyvinylbenzal (benzalization degree: 75% or higher by weight) in 95 part of cyclohexanone by a sand mill for two hours. This dispersion was applied onto the above subbing layer by the immersion coating to form a charge-generating layer in a dry thickness of 0.2 μm.

A solution for forming a charge-transporting layer was prepared by dissolving 55 parts of the triarylamine compound shown by the formula given below, and 55 parts of a polycarbonate resin (trade name: Z-400, Mitsubishi Gas Chemical Co., Ltd.) in 70 parts of tetrahydrofuran. This solution was applied onto the above charge-generating layer by the immersion coating to form a charge-transporting layer in a dry thickness of 10 μm.

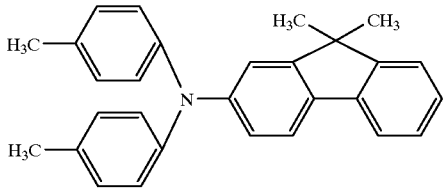

The protection layer forming composition I prepared in Example 1 was applied onto the above charge-transporting layer by the immersion coating, and dried and heat-treated at 110° C. for 4 hours to form a protection layer of 0.4 μm thick.

Thus the electrophotographic photosensitive member of the present invention was produced.

The water contact angle of the surface of the photosensitive member was 101°.

The photosensitive member was tested for the electrophotographic characteristics at a wavelength of 680 nm at a charging voltage of −700 V. As a result, $E_{1/2}$ (light exposure quantity to decrease the charged voltage to −350 V) was 0.1 μJ/cm$^2$, and the residual potential was 55 V satisfactorily.

This electrophotographic photosensitive member was set on a laser beam printer LBP-8 Mark II (manufactured by Canon K.K.) having an AC charging roller which had been modified for the aforementioned irradiation spot conditions. With this apparatus, an image was formed and the copied image was evaluated at the initial charging of −500 V. After the 4000-sheet copying durability test, the abrasion of the photosensitive member was as small as 0.1 μm or less; the water contact angle after the durability test was 98° desirably; no image deterioration was observed; and reproducibility of one picture element in a highlight portion was sufficient at input signals corresponding to 600 dpi.

EXAMPLE 3

In a flask, was placed 3.9 g of an aqueous dispersion of colloidal silica (solid content: 40% by weight). To the aqueous dispersion were added 26.8 g of a dispersion of colloidal silica in isopropyl alcohol (solid content: 30% by weight), 1.5 g of methyltriethoxysilane, 1.9 g of γ-glycidoxypropyltrimethoxysilane, 2.4 g of 3,3,4,4,5,5,6,6,6-nonafluorohexyltrimethoxysilane, and 3.1 g of acetic acid with stirring. After completion of the addition, the mixture solution was heated to 65 to 70° C. to allow the reaction to proceed for two hours. Then the reaction mixture was diluted with 23.3 g of isopropyl alcohol, and 2.4 g of benzyltrimethylammonium acetate as a curing catalyst, and 0.16 g of a solution of 10% by weight of polyether-modified dimethylsilicone in ethanol were added to obtain a protection layer forming composition. This is called composition II.

This protection layer forming composition II was applied onto a glass plate by the bar coating, dried and heat-treated at 110° C. for 4 hours to obtain a sample having a transparent film of 1 μm thick. This is called sample III.

The film of this sample III was transparent, and the absorbance of the film was 0.001 at a wavelength of 600 nm per μm thickness as measured by a spectrophotometer.

The water contact angle was 96°, showing sufficiently lowered surface energy of the film. The pencil hardness of the film was as high as 7H. The volume resistivity was $1\times10^{11}$ Ωcm as measured by use of a comb type electrode. The universal hardness Hu was 413 N/mm$^2$.

Separately, a film was formed on an aluminum plate by use of 4-[2-(triethoxysilyl)ethyl]triphenylamine, and a polycarbonate resin (trade name: Z-200, produced by Mitsubishi Gas Chemical Co., Inc.) in the same manner as in Example 1. Onto this film, the previously prepared protection layer forming composition II was applied by the bar coating, and was dried and heat-treated at 110° C. for 4 hours to obtain a sample having a surface protection layer of 1 μm thick formed thereon. This is called sample IV. The sample IV was found to have a uniform protection layer by the examination using a microscope.

The resistance of the sample IV to discharge was evaluated in the same manner as in Example 1. As the result, the formed hollow portion had a depth of as small as not more than 0.1 μm.

The water contact angle at the electric discharge portion was 93° even after the deterioration test, which was satisfactory in comparison with the value 96° before the deterioration test.

EXAMPLE 4

A mirror-polished aluminum cylinder of 60 mm in the outside diameter was coated with alumite by the anodic oxidation. This cylinder was used as an electroconductive support.

A coating liquid for a charge-generating layer was prepared by dispersing 5 parts of the bisazo pigment shown by the formula below in a solution of 2 parts of polyvinylbenzal (benzalization degree of 75% or higher by weight) in 95 parts of cyclohexanone by a sand mill for 20 hours. This liquid dispersion was applied onto the electroconductive support in a dry thickness of 0.2 μm by the immersion coating to form a charge-generating layer.

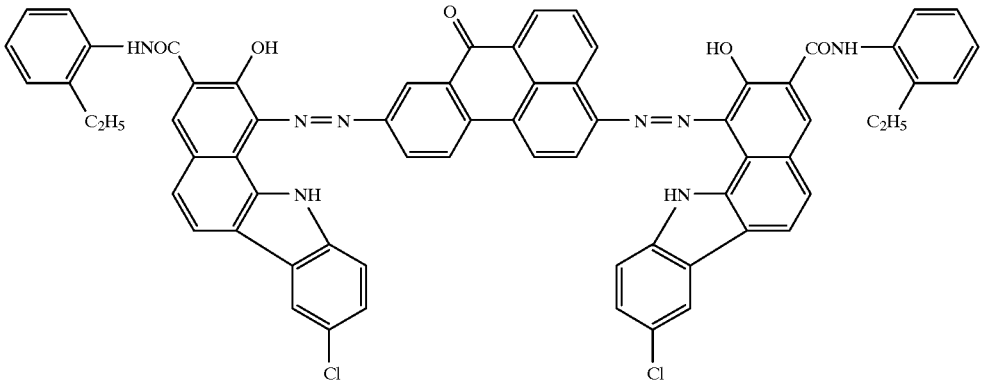

A coating liquid for forming a charge-transporting layer was prepared by dissolving 5 parts of the triarylamine used in Example 2, and 5 parts of a polycarbonate resin (trade name; Z-400, Mitsubishi Gas Chemical Co.,Inc.) in 70 parts of tetrahydrofuran. This solution was applied on the charge-generating layer by the immersion coating to form a charge-transporting layer in a dry thickness of 12 μm.

On the above charge-transporting layer, the protection layer forming composition II of Example 3 was applied by the immersion coating, dried and heat-treated at 110° C. for 4 hours to form a protection layer of dry thickness of 1 μm.

Thus, the electrophotographic photosensitive member of the invention was completed.

The obtained photosensitive member was tested for the electrophotographic characteristics at a wavelength of 680 nm by charging at −700 V. $E_{1/2}$ (light exposure to decrease the charged voltage to −350 V) was 1.2 μJ/cm$^2$, and the residual potential was 28 V, which results were good.

This electrophotographic photosensitive member was set on a digital copying machine GP55 (roller charging system, manufactured by Canon K.K.) which had been modified to give the aforementioned irradiation spot diameter. With this apparatus, images were formed and evaluated at the initial charging at −600 V. The image output was sufficiently uniform from the initial stage through 5000-sheet copying in the copying durability test; the gradation reproducibility was excellent to give 256 gradations at 400 dpi; and the abrasion of the photosensitive member was as small as 0.1 μm after 5000-sheet copying durability test.

The water contact angle on the surface of the photosensitive member was found to be 96° at the initial stage, and 93° at the time of 5000-sheet copying. Thus, the results were good.

EXAMPLE 5

A mirror-polished aluminum cylinder of 80 mm in the outside diameter was coated with alumite by the anodic oxidation. This cylinder was used as an electroconductive support. A charge-generating layer, a charge-transporting layer, and a protection layer were formed on the support in the same manner as in Example 4 to prepare an electrophotographic photosensitive member of the present invention.

This electrophotographic photosensitive member was set on a digital copying machine CLC500 (corona charging system, manufactured by Canon K.K.) which had been modified to provide the aforementioned irradiation spot diameter. With this apparatus, the copied image was evaluated at the initial charging at −500 V. The image output was sufficiently uniform from the initial stage through the 5000-sheet copying durability test; the gradation reproducibility was excellent to give 256 gradations at 400 dpi; and the abrasion of the photosensitive member was as small as 0.1 μm after the 5000-sheet copying durability test.

The water contact angle on the surface of the photosensitive member was found to be 96° at the initial stage, and 90° even after 5000-sheet copying, which results were satisfactory.

EXAMPLE 6

In a flask, was placed 4.1 g of an aqueous dispersion of colloidal silica (solid content: 40% by weight). To the aqueous dispersion were added 26.5 g of a dispersion of colloidal silica in isopropyl alcohol (solid content: 30% by weight), 1.8 g of methyltriethoxysilane, 2.4 g of γ-glycidoxypropyltrimethoxysilane, 1.1 g of n-perfluorooctylethyltriethoxysilane, and 3.1 g of acetic acid with stirring. After completion of the addition, the mixture solution was heated to 65 to 70° C. to allow the reaction to proceed for 2 hours. Then the reaction mixture was diluted with 23.1 g of isopropyl alcohol, and 2.8 g of dibutyltin di-2-ethylhexanoate as a curing catalyst, and 0.16 g of a solution of 10% by weight of polyether-modified dimethylsilicone in ethanol were added to obtain a protection layer forming composition. This is called composition III.

The protection layer formed from the protection layer forming composition III had a pencil hardness of 5H, and a universal hardness of 415 N/mm$^2$.

A liquid dispersion for an electroconductive layer was prepared by dispersing 200 parts of ultrafine particulate electroconductive barium sulfate (primary particle diameter: 50 nm) in a solution of 167 parts of a phenol resin (trade name: Priophen, Dainippon Ink and Chemicals, Inc.) in 100 parts of methylcellosolve. This dispersion was applied on an aluminum cylinder having an outside diameter of 30 mm which was obtained by the drawing in the same manner as in Example 2. The application was done by the immersion coating to form an electroconductive layer in a dry thickness of 10 μm. On this electroconductive support, a subbing layer of 1 μm thick, and a charge-generating layer of 0.2 μm thick were formed in the same manner as in Example 2.

A solution for forming a charge-transporting layer was prepared by dissolving 5 parts of the triarylamine compound employed in Example 2, and 5 parts of a polycarbonate resin (trade name: Z-400, Mitsubishi Gas Chemical Co., Ltd.) in 70 parts of chlorobenzene. This solution was applied onto the above charge-generating layer by the immersion coating to form a charge-transporting layer in a dry thickness of 10 μm.

The protection layer forming composition III prepared above was applied on the above charge-transporting layer by the spray coating, and dried and heat-cured at 110° C. for 4 hours to prepare a protection layer of 0.5 μm thick. Thus, the electrophotographic photosensitive member of the present invention was produced.

The water contact angle of the surface of the photosensitive member was 90°.

The photosensitive member was tested for the electrophotographic characteristics at a wavelength of 680 nm by charging at −700 V. $E_{1/2}$ (light exposure to decrease the charged voltage to −350 V) was 0.14 μJ/cm$^2$, and the residual potential was 51 V. Thus, the results were good.

This electrophotographic photosensitive member was set on a laser beam printer LBP-8 Mark II (manufactured by Canon K.K.) in which the optical system had been changed to a semiconductor laser of 780 nm, 100 mW to provide the laser spot size of 60×20 μm$^2$. With this apparatus, an image was formed and the copied image was evaluated at the initial charging of −500 V. After the 4000-sheet copying durability test, the abrasion of the photosensitive member was as small as less than 0.1 μm; the water contact angle after the durability test was as good as 89°; image deterioration such as black spots caused by charge injection and interference fringes was not observed; and reproducibility of one picture element in a highlight portion was sufficient at input signals corresponding to 600 dpi.

EXAMPLE 7

On the same aluminum cylinder as the one in Example 2, an electroconductive layer, a subbing layer, and a charge-generating layer were formed in the same manner as in Example 2.

A solution for a charge-transporting layer was prepared by dissolving 55 parts of the triarylamine compound employed in Example 2, and 55 parts of a polycarbonate resin (trade name: Z-400, Mitsubishi Gas Chemical Co., Ltd.) in 70 parts of tetrahydrofuran. This solution was applied onto the above charge-generating layer by the immersion coating to form a charge-transporting layer in a dry thickness of 20 μm.

The protection layer forming composition III prepared in Example 6 was applied onto the above charge-transporting layer by the immersion coating, and dried and heat-treated at 110° C. for 4 hours to form a protection layer of 1.5 μm thick. Thus the electrophotographic photosensitive member of the present invention was produced.

The water contact angle of the surface of the photosensitive member was 102°.

The photosensitive member was tested for the electrophotographic characteristics at a wavelength of 680 nm at a charging voltage of −700 V. $E_{1/2}$ (light exposure to decrease the charged voltage to −350 V) was 0.11 μJ/cm$^2$, and the residual potential was 42 V. Thus, the results were good.

This electrophotographic photosensitive member was set on a laser beam printer P270 (manufactured by Canon K.K.) which been modified to give the aforementioned light beam conditions, and provided with an AC charging roller. With this apparatus, an image was formed and the copied image was evaluated at the initial charging of −500 V. After the 4000-sheet copying durability test, the abrasion of the photosensitive member was as small as 0.2 μm or less; the water contact angle after the durability test was as good as 99°; and no image deterioration was observed. Although one picture element reproducibility was slightly inferior at the highlight portion at input signals corresponding to 600 dpi, it caused no problem in practical application.

EXAMPLE 8

In a flask, was placed 4.0 g of an aqueous dispersion of colloidal silica (solid content: 40% by weight). To the aqueous dispersion were added 26.7 g of a dispersion of colloidal silica in isopropyl alcohol (solid content: 30% by weight), 2.5 g of methyltriethoxysilane, 0.8 g of propyltriethoxysilane, 1.1 g of n-perfluorooctylethyltriethoxysilane, and 3.2 g of acetic acid with stirring. After completion of the addition, the mixture solution was heated to 65–70° C. to allow the reaction to proceed for 2 hours. Then the reaction mixture was diluted with 23 g of isopropyl alcohol, and 2.5 g of dibutyltin di-2-ethylhexanoate as a curing catalyst was added, and 0.1 g of a solution of 10% by weight polyether-modified dimethylsilicone in ethanol were further added to form a protection layer forming composition. This is called composition IV.

This protection layer forming composition IV was applied onto a glass plate by the bar coating, and the applied composition was dried and heat-treated at 140° C. for 4 hours to obtain a sample having a uniform transparent film of 4 μm thick. This is called sample V.

The film of the sample V was transparent, and had an absorbance of 0.002 per μm thickness at a wavelength of 600 nm as measured by spectrophotometry.

The water contact angle was 109°, showing sufficiently low surface energy of the film. The pencil hardness was as high as 5H. The universal hardness Hu was 360 N/mm$^2$. The volume resistivity was $5\times10^{13}$ Ωcm as measured by use of a comb type electrode.

On the same aluminum cylinder as the one employed in Example 2, an electroconductive layer, a subbing layer, and a charge-generating layer were formed in the same manner as in Example 2.

A solution for forming a charge-transporting layer employed in Example 7 was applied onto the above charge-generating layer by the immersion coating in a dry thickness of 10 μm. Further, the protection layer forming composition IV was applied on the charge-transporting layer by the immersion coating, and was dried and heat-treated at 120° C. for 4 hours to form a protection layer of 1.0 μm thick. Thus the electrophotographic photosensitive member of the present invention was produced.

The water contact angle of the surface of the photosensitive member was 102°.

The photosensitive member was tested for the electrophotographic characteristics at a wavelength of 680 nm at a charging voltage of −700 V. $E_{1/2}$ (light exposure to decrease the charged voltage to −350 V) was 0.11 μJ/cm$^2$, and the residual potential was 48 V. These results were satisfactory.

This electrophotographic photosensitive member was set on a laser beam printer LBP-8 Mark II (manufactured by Canon K.K.) which been modified to give the aforementioned irradiation spot conditions, and provided with an AC charging roller. With this apparatus, an image was formed and the copied image was evaluated at the initial charging of −500 V. After the 4000-sheet copying durability test, the abrasion of the photosensitive member was as small as 0.2 μm or less; the water contact angle after the durability test was as good as 99° desirably; no image deterioration was observed; and one picture element reproducibility was sufficient at the highlight portion at input signals corresponding to 600 dpi.

EXAMPLE 9

In a flask, was placed 9.4 g of an aqueous dispersion of colloidal silica (solid content: 40% by weight). To the aqueous dispersion were added 19.1 g of a dispersion of colloidal silica in isopropyl alcohol (solid content: 30% by weight), 19.9 g of methyltriethoxysilane, 9.2 g of ethyltriethoxysilane, and 3.2 g of acetic acid with stirring. After completion of the addition, the mixture solution was heated to 65 to 70° C. to allow the reaction to proceed for 2 hours. Then the reaction mixture was diluted with 22 g of isopropyl alcohol, and 2.4 g of benzyltrimethylammonium acetate as a curing catalyst was added, and further 0.1 g of a solution of 10% by weight polyether-modified dimethylsilicone in ethanol were added to obtain a protection layer forming composition. This is called composition V.

This protection layer forming composition V was applied onto a glass plate by the bar coating, dried and heat-treated at 140° C. for 4 hours to obtain a sample having a uniform transparent film of 3 μm thick. This is called sample VI.

The film of the sample VI was transparent, and showed an absorbance of 0.002 per μm thickness at a wavelength of 600 nm as measured by spectrophotometry.

The water contact angle was 95°, showing sufficiently low surface energy of the film. The pencil hardness was as high as 6H. The universal hardness Hu was 387 N/mm$^2$. The volume resistivity was $1\times10^{13}$ Ωcm as measured by use of a comb type electrode.

On the same aluminum cylinder as the one employed in Example 2, an electroconductive layer, a subbing layer, and a charge-generating layer were formed in the same manner as in Example 2.

A solution for forming a charge-transporting layer as employed in Example 7 was applied on the above charge-generating layer by the immersion coating in a dry thickness of 8 μm. Further, the protection layer forming composition V was applied onto the charge-transporting layer by the immersion coating, and was dried and heat-treated at 120° C. for 4 hours to form a protection layer of 1.0 μm thick. Thus the electrophotographic photosensitive member of the present invention was produced.

The water contact angle of the surface of the photosensitive member was 95°.

The photosensitive member was tested for the electrophotographic characteristics at a wavelength of 680 nm by charging at −700 V. $E_{1/2}$ (light exposure to decrease the charged voltage to −350 V) was 0.11 μJ/cm$^2$, and the residual potential was 45 V, which results were satisfactory.

This electrophotographic photosensitive member was set on a laser beam printer LBP-8 Mark II (manufactured by Canon K.K.) which been modified to give the aforementioned irradiation spot conditions, and provided with an AC charging roller. With this apparatus, an image was formed and the copied image was evaluated at the initial charging of −500 V. After the 4000-sheet copying durability test, the abrasion of the photosensitive member was as small as 0.2 μm or less; the water contact angle after the durability test was as good as 90°; no image deterioration was observed; and one picture element reproducibility was sufficient at the highlight portion at input signals corresponding to 600 dpi.

COMPARATIVE EXAMPLE 1

4-[2-(Triethoxysilyl)ethyl]triphenylamine, and a polycarbonate resin (trade name: Z-200, produced by Mitsubishi Gas Chemical Co., Inc.) were dissolved in tetrahydrofuran in a solid matter content of 50% by weight, and 50% by weight, respectively. This solution was applied onto an aluminum plate of 50 μm thick by the bar coating in a dry thickness of 20 μm. The applied matter was dried at 120° C. for one hour to obtain a sample having a film of 20 μm thick. This is called sample VII.

This sample VII was tested for the resistance to discharge in the same manner as in Example 1. As a result, a significantly large hollow of 0.1 μm deep was formed in the sheet.

COMPARATIVE EXAMPLE 2

On the same aluminum cylinder as in Example 2, an electroconductive layer, a subbing layer, and a charge-generating layer were formed in the same manner as in Example 2.

A solution for forming a charge-transporting layer was prepared by dissolving 10 parts of the triarylamine compound employed in Example 2, and 10 parts of a polycarbonate resin (trade name: Z-400, Mitsubishi Gas Chemical Co., Ltd.) in 70 parts of chlorobenzene. This solution was applied onto the above charge-generating layer by the immersion coating to form a charge-transporting layer in a dry thickness of 18 μm.

The obtained photosensitive member was subjected to an image evaluation test with the same laser beam printer (manufactured by Canon K.K.) as that employed in Example 2. After 4,000-sheet copying durability test, interference fringes and black spots were observed in the image; the abrasion of the surface was as large as 5 μm; the water contact angle was only 72°; and reproducibility of one picture element was insufficient and non-uniform at the highlight portion at 600 dpi.

COMPARATIVE EXAMPLE 3

A coating liquid A was prepared by dissolving fine particulate polytetrafluoroethylene (Lubron LD-1, produced by Daikin Industries, Ltd., particle diameter about 0.2 μm), 4-[2-(triethoxysilyl)ethyl]triphenylamine, and a polycarbonate resin (trade name: Z-200, produced by Mitsubishi Gas Chemical Co., Inc.) in tetrahydrofuran in solid content of 5% by weight, 47.5% by weight, and 47.5% by weight, respectively.

This coating liquid A was applied to a glass plate by the bar coating, and was dried at 120° C. for one hour. The resulting film had a thickness of 10 μm and was white turbid. In this white turbid film, particles of the polytetrafluoroethylene were observed with a microscope. This film had absorbance of 0.022 per μm thickness at wavelength of 600 nm as measured by use of a spectrophotometer, which shows significant scattering of light. This film gave a water contact angle of only 86°, showing insufficient decrease of the surface energy.

On the same aluminum cylinder as that employed in Example 2, an electroconductive layer, a subbing layer, and a charge-generating layer were formed in the same manner as in Example 2. A solution for forming a charge-transporting layer was prepared by dissolving 5 parts of the triarylamine compound employed in Example 2, and 5 parts of a polycarbonate resin (trade name: Z400, Mitsubishi Gas Chemical Co., Ltd.) in 70 parts of chlorobenzene. This solution was applied onto the above charge-generating layer by the immersion coating to form a charge-transporting layer in a dry thickness of 12 μm.

Onto the charge-transporting layer, the above coating liquid A was applied by the spray coating, and was dried and heat-treated at 110° C. for 2 hours to form a protection layer of 4.0 μm thick. This protection layer had a hardness of 2H, and gave a water contact angle of only 86°.

The obtained electrophotographic photosensitive member was evaluated with the same laser beam printer as that in Example 2. As the result of 4,000-sheet durability test, the abrasion was as large as 3 μm, and one picture element reproducibility was insufficient and irregular in the highlight portions at 600 dpi.

What is claimed is:

1. An electrophotographic photosensitive member comprising a photosensitive layer and a protection layer formed on a support, wherein the protection layer contains a particulate colloidal silica and a siloxane resin to have a contact angle of water of not less than 95°, said siloxane resin comprising a compound represented by formula (I):

$$RSiO_{3/2} \quad (I)$$

wherein R is $C_nF_{2n+1}C_2H_4$— and n is an integer from 4 to 18.

2. An electrophotographic photosensitive member according to claim 1, wherein the protection layer has a pencil hardness of not lower than 5H.

3. An electrophotographic photosensitive member according to claim 1, wherein the protection layer has a universal hardness ranging from 350 to 2,000 N/mm$^2$.

4. An electrophotographic photosensitive member according to claim 1, wherein the particulate colloidal silica has an average particle diameter ranging from 5 to 150 nm.

5. An electrophotographic photosensitive member according to claim 5, wherein the particulate colloidal silica has an average particle diameter ranging from 10 to 30 nm.

6. An electrophotographic photosensitive member according to claim 1, wherein the protection layer has a volume resistivity ranging from $1\times10^9$ to $1\times10^{15}$ Ωcm.

7. An electrophotographic photosensitive member according to claim 1, wherein the siloxane resin further comprises a compound represented by the general formula (I):

$$RSiO_{3/2} \quad (I)$$

wherein R represents an alkyl group of 1–3 carbons, a vinyl group, [$C_nF_{2n+1}C_2H_4$—,] a γ-glycidoxypropyl group, or a γ-methacryloxypropyl group.

8. An electrophotographic apparatus comprising the electrophotographic photosensitive member as set forth in claim 1, a charging means for charging the electrophotographic photosensitive member, an image exposure means for exposing the charged electrophotographic photosensitive member to light image to form an electrostatic latent image thereon, and a development means for developing the formed electrostatic latent image with a toner on the electrophotographic photosensitive member.

9. A process cartridge comprising the electrophotographic photosensitive member as set forth in claim 1, and at least one of a charging means, a development means, and a cleaning means, which are combined together into one unit.

* * * * *

UNITED STATES PATENT AND TRADEMARK OFFICE

CERTIFICATE OF CORRECTION

PATENT NO. : 5,910,386

DATED : June 8, 1999

INVENTOR(S) : KAZUO YOSHINAGA, ET AL.

It is certified that error appears in the above-identified patent and that said Letters Patent is hereby corrected as shown below:

On the title page:

AT [56] REFERENCES CITED,

Under U.S. PATENT DOCUMENTS,

"11/1976 Clark" should read --3/1976 Clark--.

COLUMN 3

Line 13, "compound" should read --compounds--.
Line 14, "includes" should read --include--.

COLUMN 8

Line 22, "an a" should read --a--.

COLUMN 11

Line 45, "by" should be deleted.
Line 53, "part" should read --parts--.

UNITED STATES PATENT AND TRADEMARK OFFICE

CERTIFICATE OF CORRECTION

PATENT NO. : 5,910,386

DATED : June 8, 1999

INVENTOR(S) : KAZUO YOSHINAGA, ET AL.

It is certified that error appears in the above-identified patent and that said Letters Patent is hereby corrected as shown below:

COLUMN 20

Line 17, "claim 5," should read --claim 4,--.
Line 36, "light image" should read --image light--.

Signed and Sealed this

Seventh Day of December, 1999

*Attest:*

Q. TODD DICKINSON

*Attesting Officer*

*Acting Commissioner of Patents and Trademarks*